United States Patent [19]

Gratsch et al.

[11] 4,073,206

[45] Feb. 14, 1978

[54] LONG-HANDLED CUTTING APPARATUS FOR A CLOTH SPREADING MACHINE

[75] Inventors: Jack M. Gratsch, Cincinnati, Ohio; Cecil S. Frederick, Murfreesboro, Tenn.

[73] Assignee: Cutters Machine Company, Inc., Nashville, Tenn.

[21] Appl. No.: 762,948

[22] Filed: Jan. 27, 1977

[51] Int. Cl.[2] ..... B26D 1/20

[52] U.S. Cl. ..... 83/489; 83/508; 83/574; 83/614; 270/31

[58] Field of Search ..... 83/489, 508, 574, 614; 270/31, 30

[56] References Cited

U.S. PATENT DOCUMENTS

| | | | |
|---|---|---|---|
| 231,857 | 8/1880 | Smith | 83/614 X |
| 1,455,501 | 5/1923 | McGee | 83/489 |
| 1,710,898 | 4/1929 | Rowley | 83/614 X |
| 2,006,130 | 6/1935 | Dubuc | 270/30 X |
| 3,404,879 | 10/1968 | Burris | 270/30 X |
| 3,791,246 | 2/1974 | Lazickes | 83/489 X |
| 3,858,475 | 1/1975 | Thater | 83/489 X |

FOREIGN PATENT DOCUMENTS

| | | | |
|---|---|---|---|
| 562,218 | 4/1958 | Canada | 83/489 |

*Primary Examiner*—J. M. Meister

*Attorney, Agent, or Firm*—Harrington A. Lackey

[57] ABSTRACT

A cutter head mounted upon a cloth spreading machine for longitudinal movement widthwise of the cloth spreading machine for transversely cutting cloth laid upon a cutting table. An elongated handle member is swivelly connected to said cutter head for manual movement of the cutter head over the entire width of the cloth spreading machine by an operator standing on one side of the spreading machine.

The cutter head may be removed from the spreading machine and the handle member may be rendered rigid with respect to the cutter head, so that the cutter head may be manipulated for cutting cloth independently of the cloth spreading machine.

5 Claims, 4 Drawing Figures

48
52
49
50
51
32
39
34
33
43
44
20
26
18
41'
40
42
17
24
24
40'
35
68
41
25
36
37
27
20
21
16
10
22
23
60
64
54
11
58
57
55
48
56
39
32
43
33
44
34
40'
25
30
24
40
20
37
13
14
15

LONG-HANDLED CUTTING APPARATUS FOR A CLOTH SPREADING MACHINE

BACKGROUND OF THE INVENTION

This invention relates to a cutting apparatus, and more particularly to a long-handled cutting apparatus for cutting cloth upon a cutting table.

Various types of cutting apparatus have been employed upon cloth spreading machines for transversely cutting layers of cloth upon a cutting table. Such cutting apparatus generally have been in the form of rotary knives, electrically powered, and with electrically powered motive means for moving the cutter head widthwise of the spreading machines. The motive means for the cutter heads have been powered by separate electrical motors from those driving the rotary knives, or they have incorporated rather expensive transmission means, such as chains and sprockets or gears for automatically moving the cutter head simultaneously with the rotary movement of the knife.

Moreover, various types of manually-operated, portable cutting devices have been employed for cutting patterns in multiple layers of cloth upon a cutting table, for making apparel. Such cutting devices usually comprise rotary knives driven by electrical motors, but the knives are manually motivated to follow the contours of the patterns in the cloth.

SUMMARY OF THE INVENTION

It is therefore an object of this invention to provide a cutting apparatus for cutting cloth, primarily for movement widthwise of a cloth spreading machine, in which the rotary knife is electrically powered, but the cutter head is manually motivated or moved, and controlled from one side of the cloth spreading machine or cutting table by a long handle.

The cutting apparatus made in accordance with this invention includes a cutter head comprising a rotary cloth cutting knife driven by an electric motor. A bracket fixed to the cutter head carries an elongated guide member, or guide bar, on each side of the cutter head for longitudinal slidable movement in an elongated channel in a track member disposed horizontally and mounted widthwise upon a cloth spreading machine. An elongated handle member has a remote end portion swivelly journaled to the cutter head for swinging the handle member generally toward and away from the track member. A sleeve may be slidably mounted upon the handle member between an operative position over the swivel journal member to render the handle member rigid relative to the cutter head and an inoperative position uncovering the swivel means to permit swinging movement of the handle member. The electrical cord or conduit on the electrical motor may be carried within the hollow portion of the handle member and extend beyond the handle member, terminating in an electrical connector for connection to any convenient outlet movable with the cloth spreading machine.

When the cloth spreading machine has completed its motion for spreading one or more layers of cloth, and it is desired to transversely cut a cloth layer, the operator of the machine turns on the electric motor to drive the rotary knife, grasps the long handle member, and manually pushes the cutter head across the cloth, the guide member guiding the cutter head in a straight, transverse, horizontal path along the track member.

By removing the one guide member from the channel in the track member, and reversing the cutting apparatus end-for-end, the opposite guide member may be inserted in the channel in order to push the cutter head in the opposite widthwise direction.

Furthermore, by completely removing the cutting apparatus from the track member, and covering the swivel journal with the sleeve, the long handled cutting apparatus may be used in cutting patterns in the stacked cloth layers independently of the cloth spreading machine.

DESCRIPTION OF THE PREFERRED EMBODIMENTS

Figures 1, 2:
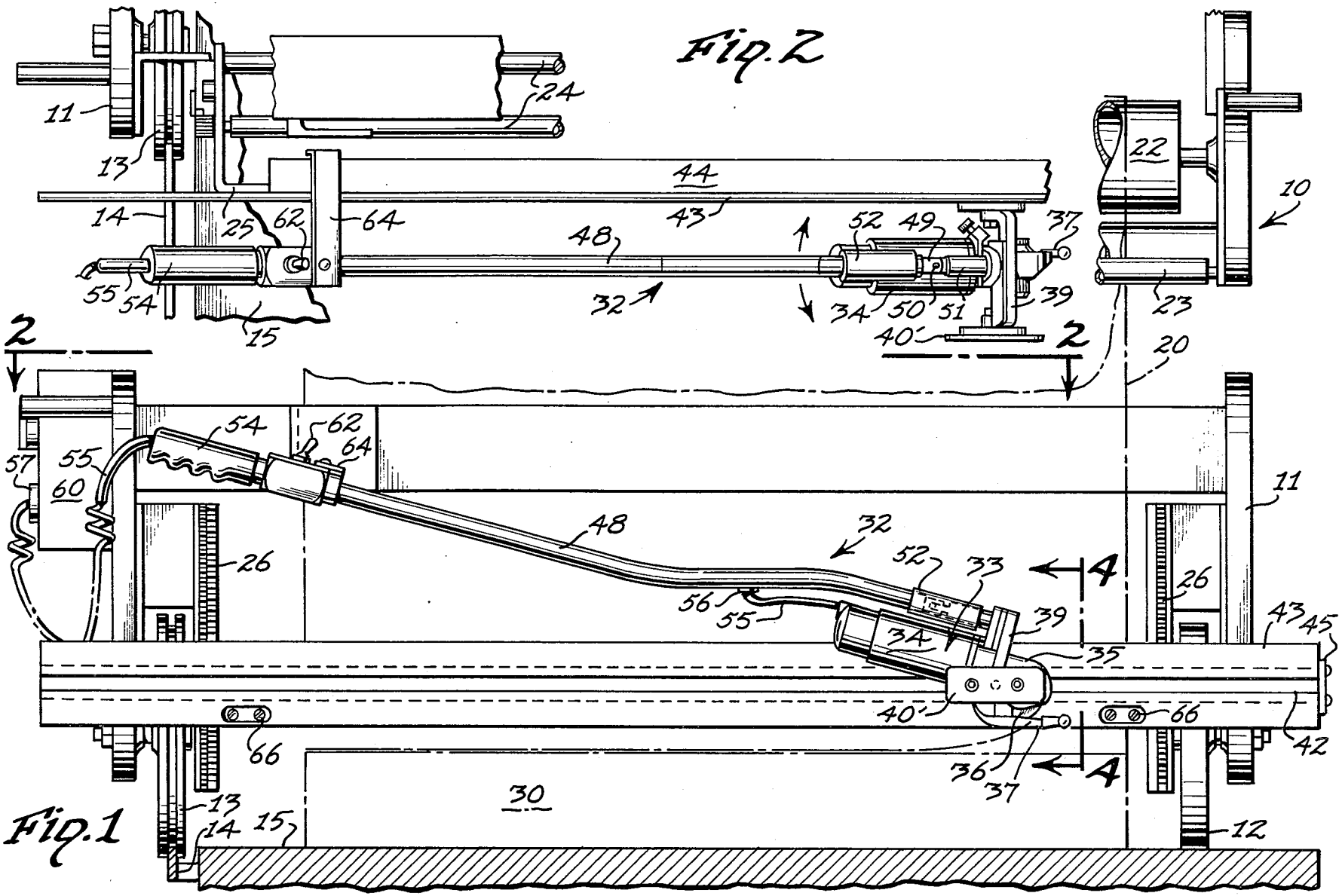
FIG. 1 is a fragmentary, front elevational view of a cloth spreading machine upon which a cutting apparatus, made in accordance with this invention, is mounted.
FIG. 2 is a fragmentary section taken along the line 2—2 of FIG. 1.

Referring now to the drawings in more detail, a cloth spreading machine 10 is disclosed including a frame or machine frame 11 supported for longitudinal reciprocal movement over a table 15 by smooth-surfaced wheels 12 on the remote side of the frame 11, running on the top surface of the cutting table 15, and grooved wheels 13 on the proximal side of the machine frame 11 running along a track or rail 14 supported alongside the cutting table 15.

Mounted on top of the machine frame 11 is a cloth supply carriage 16 having a pair of end standards 17 supporting a cloth supply roll 18.

From the cloth supply roll 18, a web of cloth or fabric 20 passes beneath a guide bar on roller 21, then over a positively driven feed roller 22 and past guide roller or bar 23 down between the spreader rollers 24.

The spreader rollers 24 are mounted in a spreader bracket 25 which is supported for vertically adjustable movement upon the vertical rack standards 26. The bracket 25 is held in its adjustable position by means, such as the pawls 27. Thus, the spreader bracket 25 may be elevated to accommodate the rise in the layers of cloth 20 spread upon the table 15.

Mounted upon the front of the cloth spreading machine 10 is the cutting apparatus 32 made in accordance with this invention. The cutting apparatus 32 includes a cutter head 33 comprising an electrical motor 34, a gear reducer 35 and a rotary knife or cutting blade 36, drivingly coupled together. The rotary blade 36 cooperates with the fixed blade arm 37 in a scissors action for cutting the cloth 20. The fixed blade arm 37 also guides the cloth 20 between the fixed blade arm 37 and the rotary blade 36 while the cloth is being cut.

A yoke-shaped bracket 39 is fixed across the cutter head 33. One depending leg of the bracket 39 supports an elongated guide bearing member 40, while the opposite depending leg of the bracket 39 supports an identical elongated guide bearing member 40'. Each of the guide bearing members 40 and 40' are preferably made of low frictional surface material, such as nylon. Each guide bearing member 40 and 40' may be attached to the corresponding leg of yoke bracket 39 by coaxial stub shafts 41 and 41', respectively, which may be fixed to the bracket 39, or journaled in the respective bracket legs about a common axis transverse to the longitudinal path of the cutter head 33.

The guide bearing member 40 is slidably received within a cooperating, elongated channel 42 formed in an elongated track member 43 which spans the entire width of the cloth spreading machine 10. The top of the track member 43 may have its rear portion reinforced by an elongated, angular reinforcing bar 44. Furthermore, the remote end of the channel 42 may be closed by a closure plate 45 to prevent the cutter head 33 from running off the remote end of the track member 43. The proximate end of the channel 42 preferably remains open so that the cutter head 33 may be removed from the track member 43. By sliding the guide bearing member 40 past the proximate open end of the cooperating channel 42, the cutter head 33 is removed from the track member 43.

The guide member 40' may be inserted into the open end of the channel 42 so that the cutter head 33 may be moved in the reverse longitudinal direction along the track member 43. Thus, the cutter head 33 could be operated from the opposite side of the machine.

If there is a track member 43 across the rear, or the opposite end, of the spreading machine 10, instead of the front as shown in the drawings, then the bearing member 40' would be inserted into the corresponding slot 42, with the cutter head 33 still retaining its same attitude relative to the track member 43.

Figures 3, 4:
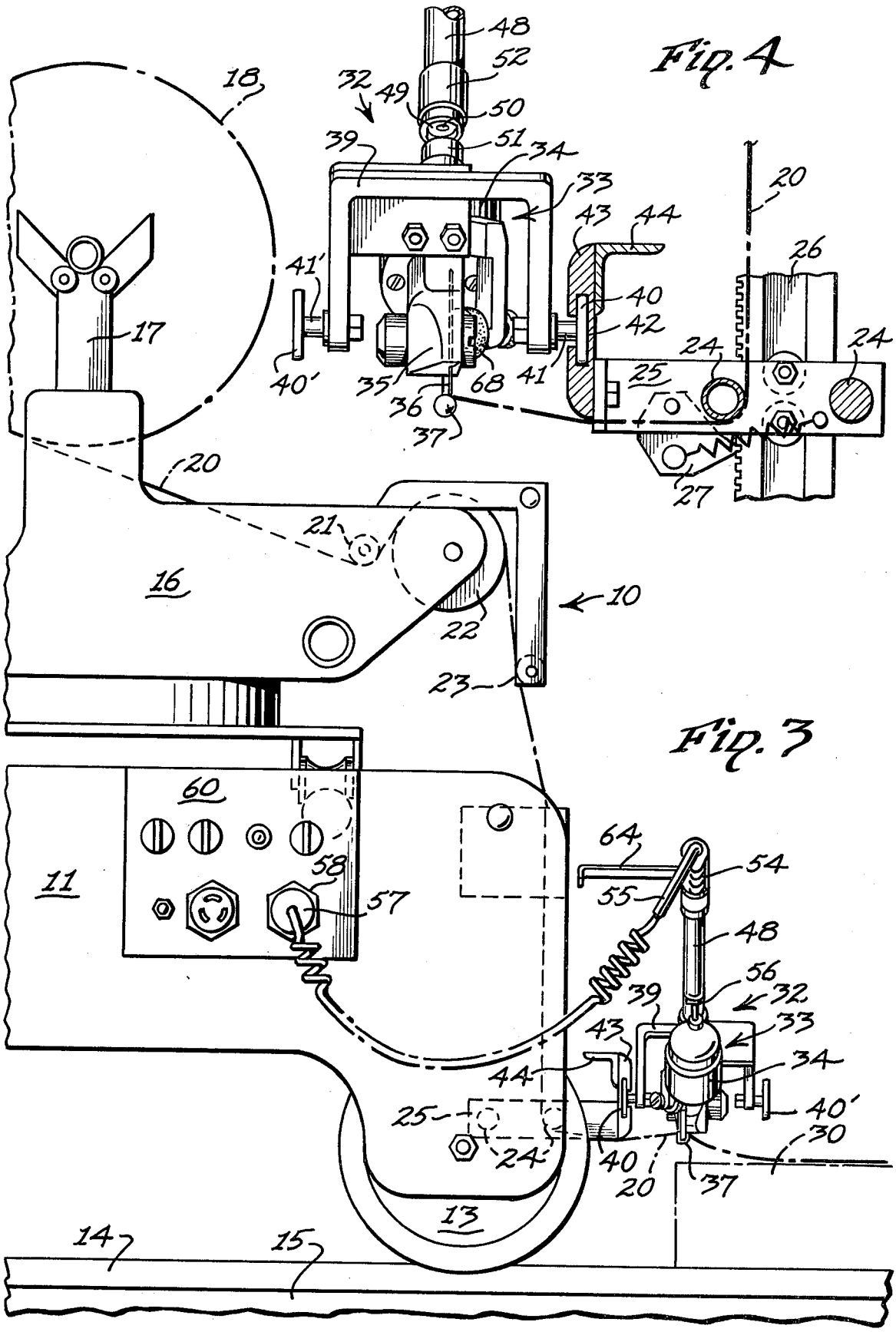
FIG. 3 is a fragmentary, right-end elevation of the cloth spreading machine and cutting apparatus disclosed in FIG. 1.
FIG. 4 is an enlarged, fragmentary, section taken along the line 4—4 of FIG. 1.

In order to manually motivate or manipulate the cutter head 33, an elongated handle member 48 is connected or coupled by a swivel joint 49 having a hinge pin 50 pivotally connected to a rod 51 fixed to the yoke bracket 39. A tubular sleeve 52 is telescopingly mounted longitudinally upon the handle member 48 for slidable movement. The sleeve 52 is adapted to be moved between an operative position, disclosed in FIG. 1, covering the swivel joint 49 and thereby rendering the handle member 48 substantially rigid relative to the cutter head 33, and an inoperative position, disclosed in FIGS. 2 and 4, uncovering the swivel joint 49 to permit the handle member 48 to freely swing about the hinge pin 50, in the direction of the arrows disclosed in FIG. 2.

The opposite or proximate end of the handle member 48 is provided with a handle grip 54. An electrical cable or cord 55 is electrically connected at its remote end to the electrical motor 34. The cord 55 extends through an opening in grommet 56 to pass substantially coaxially through the hollow, tubular handle member 48 and out through the end of the handle grip 54, where the cord 55 terminates in an electrical connector 57. The electrical connector 57, in the form of an electrical plug, is adapted to engage, or be inserted into, a cooperating electrical outlet 58 in the control panel 60 of the cloth spreading machine 10.

A manual switch 62 is mounted upon the handle member 48 adjacent the handle grip 54 for closing and opening the circuit through the electrical cord 55 to the motor 34 in order to start and stop the operation of the rotary knife 36.

A transverse hanger bar 64 is fixed to the handle member 48 adjacent the switch 62, and is adapted to rest upon the track member 43 or reinforcing bar 44 to support the cutting apparatus 32 when it is not being used.

The track member 43 may be detachably mounted upon the front of the spreader bracket 25 by threaded fastener members 66.

In the operation of the cutting apparatus 32, the track member 43 is mounted upon the front, or the rear, or both the front and the rear, of the cloth spreading machine 10 by means of the fastener members 66. The track member 43 will then lie longitudinally horizontal, widthwise of the spreading machine 10 to span the width of the cloth layers 30 spread upon the cutting table 15 by the spreading machine 10.

Either the guide bearing member 40 or 40' is inserted into the open end of the channel 42 of the track member 43, and the hanger bar 64 laid upon the top of the track member 43.

The cloth spreading machine 10 is then operated to spread the desired number of cloth layers 30. After the machine 10 is stopped, the operator grasps the handle member 54 and pulls the cutter head 33 to the proximate side of the machine 10 clearing the proximate edges of the cloth layers 30. Then the operator turns on switch 62 to energize the electrical motor 34 to start the rotary motion of the knife 36. The sleeve 52 is removed from the swivel joint 49 to its inoperative position, disclosed in FIG. 2. The operator, grasping the handle 54 then pushes the apparatus 32 along the track member 43, while the rotary cutter blade 36 cuts the fabric 20. After the cloth is completely cut across its width, the operator turns off the switch 62.

While the operator is pushing the cutter head 33 across the cloth layers 30, the swivel joint 49 permits the guide bearing member 49 to ride smoothly in the channel 42, without binding, regardless of the lateral attitude of the handle member 48. The swivel joint 49 is an important feature of the cutting apparatus 32, since rigid handle members 48 have been tried, but without success, because of the binding of the guide member 40 within the channel 42. It is extremely difficult for the operator to push the handle member 48 without changing its attitude relative to the cutter head 33.

It is possible to use the cutting apparatus 32 to cut patterns in the layers of cloth 30, after the spreading operation has been completed, and independently of the cloth spreading machine. In order to cut the patterns, the guide bearing member 40 is completely removed from the channel 42 so that the cutting apparatus 32 is separated from the track member 43, and therefore separated from the cloth spreading machine 10, except for the electrical connection through the connectors 57 and 58. The sleeve 52 is then moved into an operative position, disclosed in FIG. 1, to prevent swinging movement about the hinge pin 52, and to render the handle member 48 substantially rigid with respect to the cutter head 33. A rigid handle member 48 is preferred when the cutting apparatus 32 is used to cut patterns in the cloth, in order to enable the operator to have better control over the continuous changes in direction of the rotary knife 36 as it follows the patterns upon the cloth layers 30.

The cutting machine 32 with the swivelly mounted elongated handle member 48 has provided a capability of cutting the cloth 20 upon a spreading machine 10 with better control of the speed and movement of the apparatus 32 relative to the cloth 20.

Furthermore, the apparatus 32 is considerably less expensive to manufacture than the conventional spreader cutters incorporating automatic and power-driven motive means for the rotary cutters. Moreover, the cutting apparatus 32 is much lighter in weight and therefore easier to manipulate than conventional cloth spreaders.

What is claimed is:

1. A cutting apparatus for a cloth spreading machine comprising:

(a) a cutter head having a knife adapted to cut cloth, (b) an elongated track member having a length substantially equal to the width of a cloth spreading machine upon which said track member is adapted to be mounted, (c) mounting means for mounting said track member to extend longitudinally widthwise of said cloth spreading machine, (d) guide means on said cutter head cooperable with said track member for movement of said cutter head longitudinally of said track member, (e) an elongated handle member having a remote end portion and a handle end portion, (f) swivel coupling means connecting said remote end portion to said cutter head so that said handle member extends generally longitudinally of said track member and is adapted to swing relative to said cutter head generally toward and away from said track member, (g) a sleeve slidably mounted longitudinally upon said handle member between an operative position covering said swivel coupling means to render said handle member substantially rigid relative to said cutter head, and an inoperative position uncovering said swivel coupling means to permit said handle member to swing relative to said cutter head.

2. The invention according to claim 1 in which said swivel coupling means comprises a hinge joint having a pivotal axis normal to the longitudinal axis of said elongated handle member and in a substantially vertical plane.

3. The invention according to claim 1 in which said guide means comprises first guide means on one side of said cutter head and second guide means on the other side of said cutter head, either of said first or second guide means being cooperable with said track member for selective movement of said cutter head longitudinally of said track member in one direction or the other.

4. The invention according to claim 1 in which said track member comprises an elongated channel extending substantially the length of said track member, said guide means comprising an elongated guide member slidably received longitudinally in said channel.

5. The invention according to claim 4 further comprising a guide bracket fixed to and spanning both sides of said cutter head, said guide member comprising a first guide member fixed to said bracket on one side of said cutter head, a second guide member similar to said first guide member and fixed to said bracket on the opposite side of said cutter head and adapted to be slidably received longitudinally in said channel when said first guide member is removed from said channel, for movement of said cutter head in the opposite longitudinal direction.

* * * * *